United States Patent [19]

York

[11] 4,051,697

[45] Oct. 4, 1977

[54] HIGH PILE FABRIC

[76] Inventor: Herbert York, 30 Church Road, Great Glen, Leicestershire, England

[21] Appl. No.: 643,774

[22] Filed: Dec. 23, 1975

[30] Foreign Application Priority Data

Jan. 3, 1975 United Kingdom ..... 00200/75

[51] Int. Cl.[2] ..... D04B 9/12

[52] U.S. Cl. ..... 66/9 B

[58] Field of Search ..... 66/9 B, 50 A

[56] References Cited

U.S. PATENT DOCUMENTS

| | | | |
|---|---|---|---|
| 3,010,297 | 11/1961 | Hill | 66/9 B |
| 3,335,581 | 8/1967 | Pernick | 66/50 A |
| 3,513,666 | 5/1970 | Mischon | 60/50 A |
| 3,858,414 | 1/1975 | Mischon | 66/50 A |

*Primary Examiner*—Ronald Feldbaum

*Attorney, Agent, or Firm*—Larson, Taylor and Hinds

[57] ABSTRACT

The invention concerns a method of producing a high pile fabric on a multi-feed circular weft knitting machine in which needles are selected by the machine to take loose fibres from slivers fed to card wheels at a card or brushing station. The invention consists of reselecting needles at the card station to take varying amounts of loose fibres from the preselected slivers actually during the carding or brushing operation.

4 Claims, 6 Drawing Figures

HIGH PILE FABRIC

This invention relates generally to high pile fabrics such as are produced by the process known as 'sliver' weft knitting on weft knitting machines. That is to say, such a fabric comprises a weft knitted ground structure of spun yarn into the knitted loops of which are incorporated loose fibres which are introduced to the needles of the machine in the form of carded slivers and are caught into the knitted loops in such a way as to provide at one side of the fabric a high pile in the nature of a hair-like nap or fur.

The invention relates particularly to a method of producing a high pile fabric on a multi-feed weft knitting machine which fabric is designed specifically to simulate animal pelts or furs.

In the manufacture of sliver weft knitted simulated animal furs it is most usual to use man-made, e.g. acrylic or modified acrylic loose fibres of any desired staple length or lengths, although it is, of course also possible to use staple natural fibres of, say, wool or cotton. In any event, the loose fibres are picked, i.e. opened out, blown into bins and carded on conventional carding machines into continuous slivers of varying weights, commensurate with their cross-sectional diameters. Differently coloured loose fibres of various shades are commonly mixed together according to requirements, prior to carding.

To equip a multi-feed weft knitting machine for producing simulated animal furs of the kind described, there is provided at each feed of the machine a yarn guide for feeding to cleared needles a spun yarn and, at a card station in advance of each feed, at least one card or brushing unit or head for feeding a sliver or slivers of loose fibres to required needles.

Each such card unit or head is usually of the type comprising a driven doffing cylinder having its periphery covered with brush-like tines and adapted to convey at least one sliver of fibres to raised needles, a rear similarly tinecovered card wheel or 'swift' which conveys the sliver or slivers to the doffing cylinder, and feed means for spreading out and delivering the one or more slivers from a supply or supplies to the rear card wheel or swift. Sometimes the latter is dispensed with in which instance the doffing cylinder is the only card wheel in the unit or head, being wholly relied on to feed a sliver or slivers of loose fibers to raised needles of the machine. As to the feed means, these conventionally consist of a plurality of pairs of axially ribbed feed rollers between the nips of which the sliver or slivers passes or pass, the respective pairs of such rollers being driven, through gearing, at different speeds so as to spread out and stretch the fibres. Alternatively, and in accordance with a recent proposal, the said feed means may consist of a driven endless feed belt the external surface of which is covered with brush-like tines, means such as another similar belt being arranged in cooperation with the feed belt to perform a combing action on fibres in the course of their delivery to the doffing cylinder or the relevant card wheel, as the case may be.

The primary object of the present invention is to provide an improved method of producing weft knitted fur fabric whereby the latter is designed to exhibit at any desired locations over the entire face of its hair-like nap various novel pattern effects, hereinafter to be described.

Broadly considered, the improved method of the invention, carried out on a multi-feed circular, 'sliver', weft knitting machine, consists in effecting individual needle selection at a card or brushing station in advance of a machine feed whereby selected needles in predetermined patterning sequence are so positioned as to cause them, during the feeding of loose fibres to needles, to take either more or less loose fibres than the needles normally raised to an advanced level to collect such fibres.

Thus, for example, the selected needles may, at any predetermined positions on the card wheels, e.g. doffing cylinders, at the card or brushing stations, be so retracted in a predetermined patterning sequence from an advanced fibre-collecting level to prevent them from collecting as many loose fibres from slivers fed to these wheels as they would otherwise have done.

Alternatively, the selected needles may be raised from a relatively low fibre-collecting level to the advanced fibre-collecting level at any one of predetermined positions on the card wheel so that they collect varying amounts of loose fibres from the slivers.

The actual amount of loose fibres collected by each of the selected needles will, therefore, depend on the precise position at which the needle commences to be retracted from the aforementioned advanced level, or on the precise position at which the needle is raised, as the case may be.

Moreover where, as may be, each tined card wheel has a plurality of contracting slivers fed to it, the needles individually selected in accordance with this invention may collect a few loose fibres either from a prearranged one or from each of two or more of the said slivers, according to requirements.

Accordingly, where there is, in advance of a card or brushing station, a pre-selection of needles such that some are raised to the aforementioned advanced fibre-collecting level whilst others remain in a non-collecting low level, the method of the present invention in effect involves a re-selection of needles during the actual carding or brushing operation to achieve the novel effects concerned.

It is to be clearly understood that all selection of needles to collect loose fibres from slivers being fed to card wheels at card or brushing stations was heretofore effected in advance of such stations. That is to say, so far as we are aware, it has never previously been possible, actually during carding or brushing operations at the stations to re-select needles to take varying amounts of loose fibres from the presented slivers.

As will be appreciated, in order to carry out the improved method, there has to be provided in association with each card head or unit one or more patterning units of a form capable of effecting individual needle selection at any predetermined position or positions relative to such head or unit for the purpose of either lowering or raising predetermined needles as aforesaid, according to patterning requirements.

Thus, whilst all the patterning units associated with all the card heads or units on the multi-feed machine may be either of the needle-lowering or of the needle-raising variety, it is possible to provide in one and the same machine patterning units of both varieties.

In any event, the number of patterning units employed and their relative dispositions may, if desired, be such that they provide the possibility of any one of the full set of needles in the needle cylinder of the machine being individually retracted or raised for producing the effects desired.

It is principally the intention to use for the purpose in view patterning units of the particular form disclosed in the provisional specification of co-pending U.S. Pat. application No. 641,173.

Broadly considered, such a patterning unit comprises an outer cylindrical pattern drum which is axially tricked around its periphery, the tricks being regularly spaced apart circumferentially at the same pitch as the latch needles in the needle cylinder of the machine and the drum being rotatable about its axis; a plurality of individually slidable selector elements which are arranged to function within predetermined ones only of the axial tricks, in accordance with patterning requirements; and, housed within the rotatable outer drum, a relatively fixed core-like inner component which is also of cylindrical form and is surrounded by a suitably contoured cam formation adapted, by cooperation with complementary formations on the selector elements, to impart to the latter sliding movements to and fro within the tricks.

With such a patterning unit in use, the axis of the unit about which the outer axially tricked cylindrical drum rotates is parallel to the knitting needles in the cylinder which are to be individually selected by the unit for patterning.

If the contoured cam formation is downwardly curved, then the selector elements, when being caused to slide downwardly, will act on and lower relevant needles. But if the said formation is upwardly curved, rising selector elements will raise the needles concerned.

Patterning effects resulting from selected knitted loops of the improved fabric having caught into other loops will produce in the hair-like nap or fur contrasting density effects. For instance, this nap or fur will be less dense where some loose fibres are omitted from predetermined individual knitted loops, and by judicious distributions of such less dense points or localities all manner of interesting overall surface effects can be achieved.

The patterning according to this invention may alternatively or in addition, be relied on to produce varying depths of the hair-like nap or fur.

In cases where colour or shade changes are at least principally responsible for the desired patterning, predetermined knitted loops in either complete or in partial courses or/and wales of the ground structure of spun yarn may have caught into them loose fibres contrasting with the basic colour of the hair-like nap or fur, the individual selections of the said loops and of the one or more colours or shades being such as to display on the hair-like nap or fur coursewise or/and walewise extending bars, stripes or similar markings — if desired of varying lengths and thicknesses.

Moreover, by incorporating into different individually selected knitted loops tufts of loose fibres which themselves contrast with one another as regards quality or/and density the range or variety of the different effects it is possible to produce may be substantially extended.

To sum up, the patterning effects in the improved weft knitted fur fabric of this invention basically rely for their production upon localised or more widely spread coursewise or/and walewise extending selections in predetermined sequences of the individual knitted loops which have caught into them amounts of loose fibres which are different from the amounts caught into knitted loops elsewhere in the ground structure of spun yarn.

The patterning effects can, if required, be interspersed in either a regular or an irregular or, in fact, even in a completely random fashion with the normal or basic tufts of loose fibres incorporated elsewhere over the face of the hair-like nap or fur. In this regard, each of such interspersed effects may cover a point or localised area corresponding to a few adjoining knitted loops only. Or the areas of such interspersed patterning may each be more extensive, covering at least one group of adjoining knitted loops extending coursewise or/and walewise. Interspersed patterning effects, if they involve, as they may do, colour or shade changes, may be so designed as to produce speckled, patchy or similar effects simulating, if desired, natural variegation characteristics of some animal pelts or furs.

The invention will now be described further by way of example with reference to the accompanying drawings in which:

FIG. 1 is a diagrammatic representation showing in dotted outline a card or brushing station in advance of part of the needle bed of a multi-feed circular 'sliver' weft knitting machine, a pattern wheel being provided for retracting selected knitting needles from an advanced fibre-collecting level to a low, non fibre-collecting level, FIG. 2 is a representation similar to FIG. 1 but with the pattern wheel raising selected knitting needles from a low, non fibre-collecting level to an advanced fibre-collecting level, FIG. 3 is a perspective view of the apparatus illustrated in FIGS. 1 and 2, and FIG. 4A is a side elevational view showing a knitting needle at an advanced fibre-collecting level taking loose fibres from a doffer;

Figure 1:
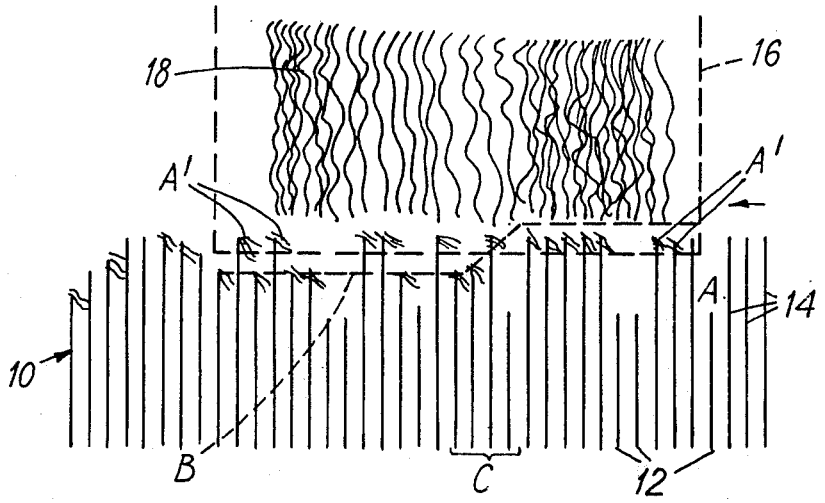

In FIG. 1 the knitting needles of a multi-feed circular 'sliver' weft knitting machine are shown generally as 10, the needles being supported in a needle bed in known manner. In this representation all of the needles are movable between a non fibre-collecting level A and a full fibre-collecting level A', those needles at the low lever A being designated 12, and those at the level A' 14. A doffer cylinder, shown dotted at 16, is disposed adjacent the needles 10 so that those needles 14 at an advanced level may take fibres 18 from the doffer cylinder whereas those 12 at the low level are unable to do so.

In operation, those needles which are to be raised to an advanced level are so raised, for example by cam selection, in the knitting machine itself in known manner. A pattern drum (not shown in FIGS. 1 and 2) is also provided, the drum being programmed according to a predetermined patterning sequence. Should the patterning sequence on the drum differ from that on the knitting machine itself, then the needles which are at one level must be brought to the other level, i.e. the level dictated by the patterning sequence on the drum. Needle reselection is achieved over the zone designated C in a manner to be described hereafter. In FIG. 1 certain selected needles 14 at the advanced fibre-collecting level A' are being retracted to the non fibre-collecting level A in the zone C, whereas in FIG. 2 certain needles 12 are being advanced at B' to the fibre-collecting level A', again over the zone C.

Referring again to FIG. 1 a reselection of needles is effected from the needles 14 and those thus selected are retracted to a somewhat lower position B in a predetermined patterning sequence so as to cause them to take less loose fibres than the full complement of fibres previously taken by the needles remaining at the higher level.

Figure 2:
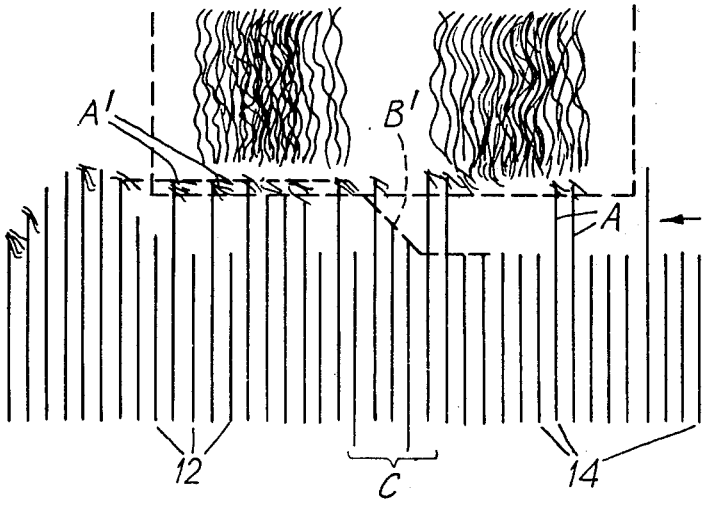
Figure 3:
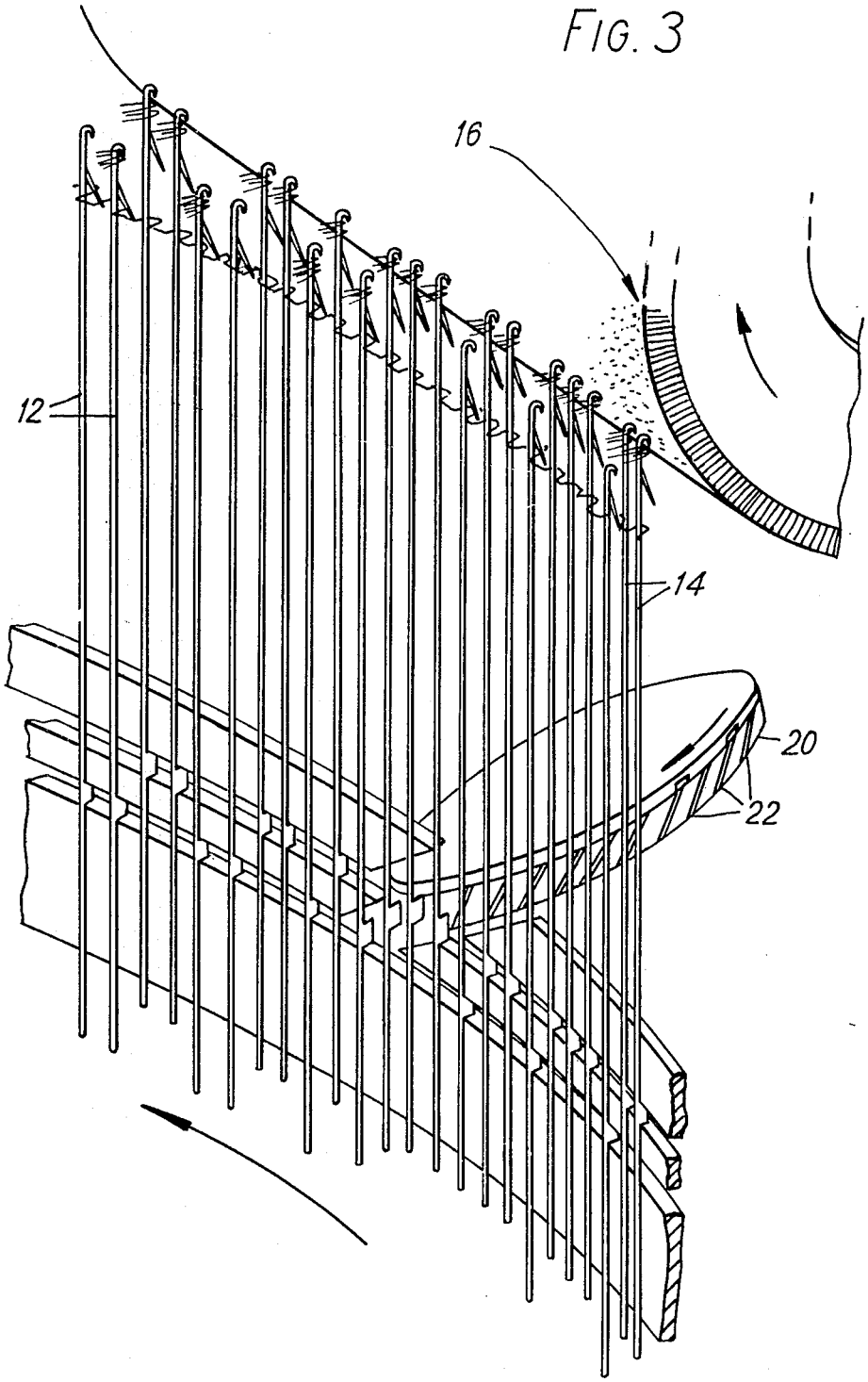

In FIG. 3 the same reference numerals have been used to designate the same parts as those in FIGS. 1 and 2. The pattern wheel is designated 20 and is tricked at 22 around its periphery, the tricks being spaced apart at the same pitch as the knitting needles 10. The wheel is rotatable about its axis, rotation of the wheel, where appropriate, causing needles to be moved from one level to the other by suitable engagement of the needle butts in thereof.

Figure 4A:
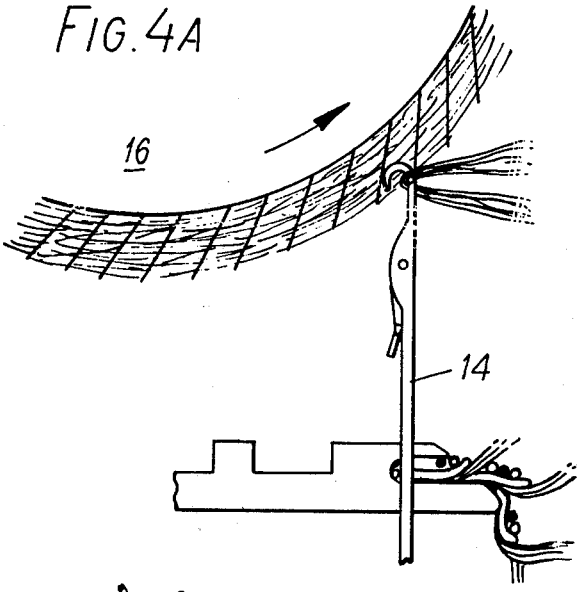
FIG. 4B shows the needle of FIG. 4A being withdrawn whilst carrying loose fibre and just engaging an element of spun yarn which is to be weft knitted to provide a knitted ground structure.
FIG. 4C shows the needle of FIGS. 4A and 4B having engaged the spun yarn drawing both yarn and the fibres through a previously knitted loop.
Figure 4B:
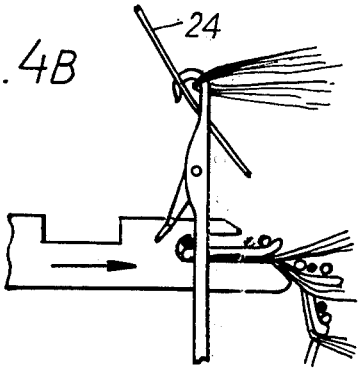
Figure 4C:
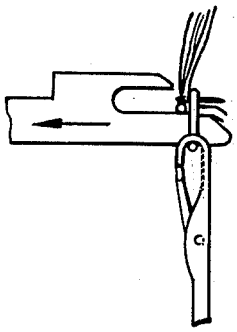

FIGS. 4A, 4B and 4C illustrate the knitting operation. In FIG. 4A a needle is shown at an advanced fibre-collecting level, the hook of the needle passing through the wires of the doffer and collecting fibres. Having collected fibres the needle is then lowered to take the ground yarn 24 as may be seen from FIG. 4B. The lowered needle containing both the ground yarn and the fibres then descends to stitch forming or knocking over level so that the said yarn and fibre are pulled through a previously knitted loop as may be seen from FIG. 4C. A jet of air from a nozzle can be used to keep tufts of fibre in position with the ground yarn.

What is claimed is:

1. A method of producing a high pile fabric simulating an animal pelt or fur on a multi-feed circular weft knitting machine which comprises feeding a plurality of loose fibers in the form of carded slivers to a fiber-collecting station disposed adjacent a needle bed of the multi-feed circular weft knitting machine so that the needles in the bed pass the station during knitting, effecting a needle preselection on the knitting machine to raise selected knitting needles from a first, non-fiber collecting level in which the needles do not collect fibers at said fiber-collecting station to a second, fiber-collecting level in which the selected needles collect fibers from said fiber-collecting station during the passage of said selected needles past said station, permitting said selected needles to collect fiber from said fiber-collecting station, and effecting a needle reselection in predetermined pattern sequence while said preselected needles are collecting fiber from said fiber-collection station so to provide a variation in the needles which collect fiber.

2. A method as claimed in claim 1 wherein said needle reselection step causes certain of the needles selected during the step of needle preselection to be withdrawn from said fiber-collecting station and to take no further fibers.

3. A method as claimed in claim 1 wherein said needle preselection step causes some of the needles not selected during the step of needle preselection to be selected in predetermined pattern sequence and raised to said second, fiber-collecting level to collect fibers during the latter part of the passage of the needles past the fiber-collecting station.

4. A method as set forth in claim 1 wherein the step of needle reselection is performed by a tricked, pattern wheel disposed below said fiber-collecting station and which acts on butts on the needles to selectively raise or lower the needles in accordance with predetermined pattern sequence.

* * * * *